United States Patent [19]

Elkind et al.

[11] Patent Number: 4,778,049

[45] Date of Patent: Oct. 18, 1988

[54] MOUNTABLE ARTICLE CARRIER HAVING PIVOTABLE LID

[76] Inventors: Lev Elkind, 6151 Benmore St.; Alex Shapiro, 2544 Cedar St., both of Long Beach, Calif. 90815

[21] Appl. No.: 108,443

[22] Filed: Oct. 15, 1987

[51] Int. Cl.[4] ..... B65D 85/10

[52] U.S. Cl. ..... 206/250

[58] Field of Search ..... 206/250, 249

[56] References Cited

U.S. PATENT DOCUMENTS

| | | | |
|---|---|---|---|
| 576,653 | 2/1897 | Bowlby | 206/250 X |
| 1,332,420 | 3/1920 | Ward | 206/250 X |
| 1,545,317 | 7/1925 | Hasselroth | 206/250 X |
| 1,596,498 | 8/1926 | Macchiavello | 206/250 X |
| 1,884,030 | 10/1932 | Maddox . | |
| 1,928,759 | 10/1933 | McQuillen | 206/250 |
| 1,957,293 | 5/1934 | Reilly | 206/250 |
| 1,978,497 | 10/1934 | Wind | 206/250 X |
| 1,988,546 | 1/1935 | Duhan . | |
| 2,030,305 | 2/1936 | Koehler | 206/250 |
| 2,039,559 | 5/1936 | Segal . | |
| 2,262,318 | 11/1941 | Fox . | |
| 2,512,207 | 6/1950 | Isaac . | |
| 3,272,321 | 9/1966 | Tamarin . | |

FOREIGN PATENT DOCUMENTS

| | | | |
|---|---|---|---|
| 131444 | 4/1951 | Sweden | 206/250 |
| 2507 | 7/1893 | United Kingdom | 206/250 |
| 110216 | 10/1917 | United Kingdom | 206/250 |

*Primary Examiner*—William Price

*Attorney, Agent, or Firm*—Laurence R. Brown; Alfred J. Mangels

[57] ABSTRACT

A container for carrying small articles, the container including a pivotable top lid that is manually pivotable from a closed position to an open position. The container includes an inner container that is slidably carried within an outer container, the inner container having an open top. The lid of the outer container carries a push button for releasing the lid for pivoting movement about a shaft carried within the container. The pivotable lid also includes a lid that is adapted to engage a side wall of the inner container so that as the pivotable lid is pivoted from a closed to an open position, the inner container is carried upwardly toward the opening in the outer container by the lip on the pivotable lid, thereby carrying the articles closer to the open top of the outer container to facilitate removal therefrom. The outer container can optionally be slidably carried in a container sleeve that includes structure to permit the sleeve to be securely mounted to a surface.

9 Claims, 2 Drawing Sheets

MOUNTABLE ARTICLE CARRIER HAVING PIVOTABLE LID

BACKGROUND OF THE INVENTION

1. Field of the Invention

This invention relates to containers for carrying small articles, and more particularly to a container that can be mounted on or secured to a surface, and that includes a pivotable lid to selectively permit access to the interior of the container.

2. Description of the Related Art

There have been developed in the past many types of containers suitable for carrying small articles. By small articles is meant such items as cigarettes, coins, jewelry, and the like. Oftentimes, however, it is difficult to retrieve small articles from within a container, particularly when the container is relatively large and the articles are relatively small, and a number of the articles have previously been removed from the container leaving only a small number of articles at the bottom.

An example of a container that elevates the contents for easy removal is disclosed in U.S. Pat. No. 2,262,318, which issued Nov. 11, 1941, to H.B. Fox. In that particular patent a container is disclosed in which an elastic sling is provided below an inner cartridge or package, so that when the container is opened, the sling will draw the package upwardly toward the opening of the container and thereby facilitate dispensing of the material. However, the Fox container is intended to be sold with the product and disposed of after use.

Another type of container that is known in the art and in which the contents are elevated for easy removal is disclosed in U.S. Pat. No. 1,884,030, which issued Oct. 25, 1932, to J.W. Maddox. As therein disclosed, a container includes at its base an upwardly bowed arm that bears against the bottom of an inner package and is connected to an outwardly extending lip that can be actuated to urge the inner package upwardly toward the opening when the lid of the container is opened. However, the disclosed container requires separate operations to open and close the container on the one hand, and to elevate or retract the contents on the other hand.

Accordingly, it is an object of the present invention to provide an improved container for receiving and holding small articles, wherein the container is reusable and is of simple construction.

Another object of the present invention is to provide a container for receiving small articles, wherein the container is so configured that simultaneously with the opening of the container the inner contents thereof are moved upwardly toward the opening to facilitate removal.

Another object of the present invention is to provide a container for small articles, wherein the container can be readily opened in a one-handed operation and without excessive attention on the part of the person wishing to remove articles from the container.

SUMMARY OF THE INVENTION

Briefly stated, in accordance with one aspect of the present invention, a container is provided for carrying small articles. The container includes an outer container having an open top, and carries a lid pivotable relative to the open top between an open and a closed position. An inner container having an open top is slidably positioned within the outer container for movement toward and away from the open top of the outer container. A manually operable lid opening means is carried by the outer container for opening the top lid of the outer container and for simultaneously sliding the inner container toward the open top of the outer container to present articles positioned within the inner container for easy removal therefrom.

In accordance with another aspect of the present invention, a mountable container for small articles is provided, the container includes a holder for receiving and holding an outer container, the container holder being in the form of a closed end sleeve and including mounting means for mounting the holder to a surface. An outer container is received in the holder, and includes a pivotable top lid. An inner container is slidably positioned within the outer container for movement toward and away from the outer container, and the pivotable lid of the outer container is operable to simultaneously slide the inner container toward the open top of the outer container to present articles positioned within the inner container for easy removal therefrom.

DESCRIPTION OF THE PREFERRED EMBODIMENTS

Figure 1:
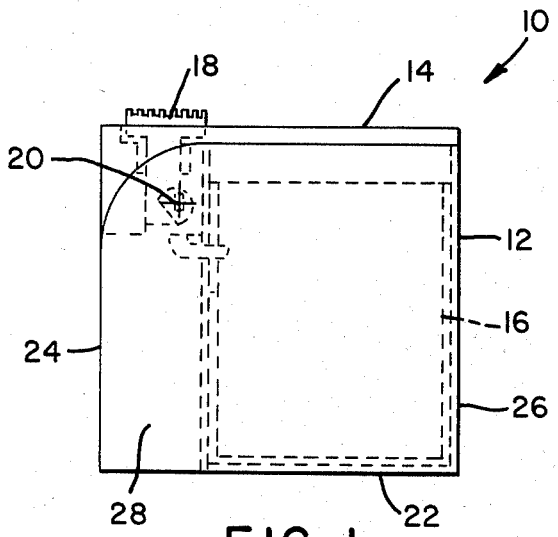
FIG. 1 is a front view of a container in accordance with the present invention having a pivotable cover lid.
Figure 2:
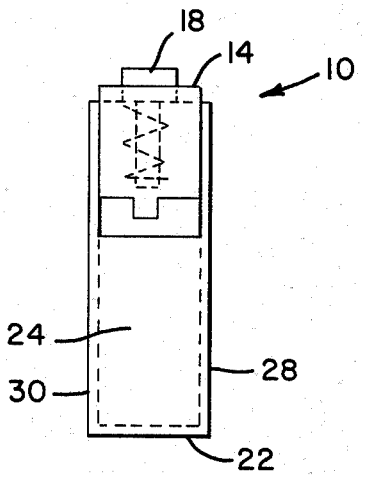
FIG. 2 is a left side view of the container illustrated in FIG. 1.
Figure 3:
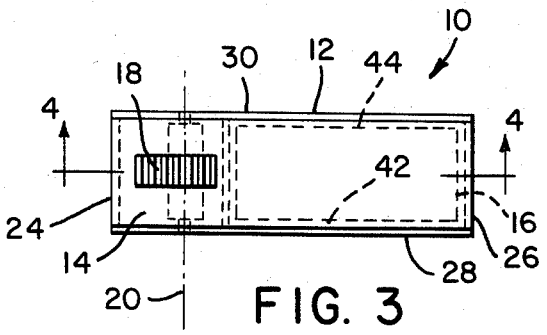
FIG. 3 is a top view of the container illustrated in FIG. 1.

Referring now to the drawings, and particularly to FIGS. 1 through 3 thereof, there is shown a article carrier 10 for carrying small articles such as cigarettes, coins, jewelry, and the like. The article carrier is of generally rectangular configuration and includes an outer container 12 having a top wall 14 defining a pivotable cover lid, and an inner container 16 in the form of an article carrier of generally rectangular cross section slidably received within the outer container. Top wall 14 of article carrier 10 is pivotable toward and away from the open top of outer container 12. A push button 18 is carried by top wall 14 to release it for rotation about a pivot axis 20 to thereby expose the contents of inner container 16 to permit removal of articles therefrom.

Figure 4:
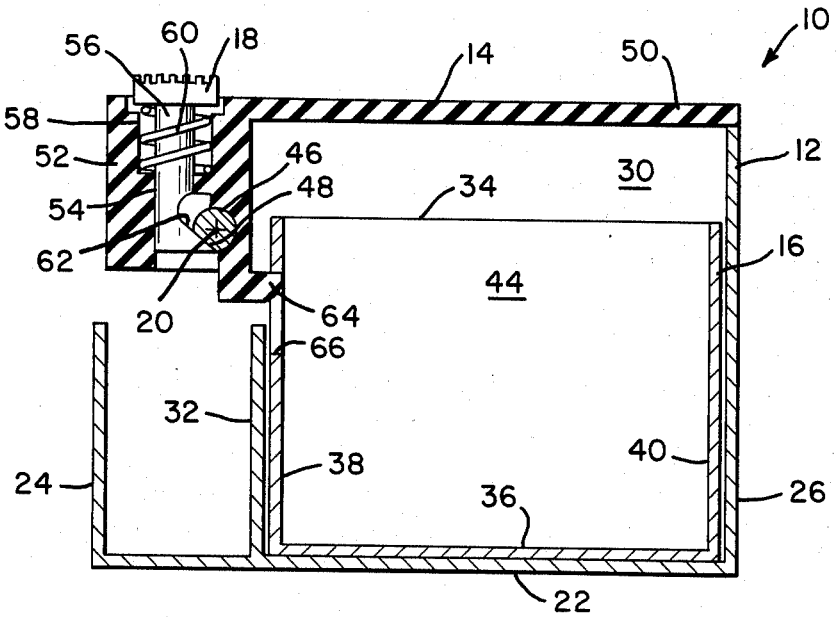
FIG. 4 is a cross-sectional view of the container illustrated in FIGS. 1, 2, and 3, taken along the line 4—4 of FIG. 3 and with the lid in the closed position.
Figure 5:
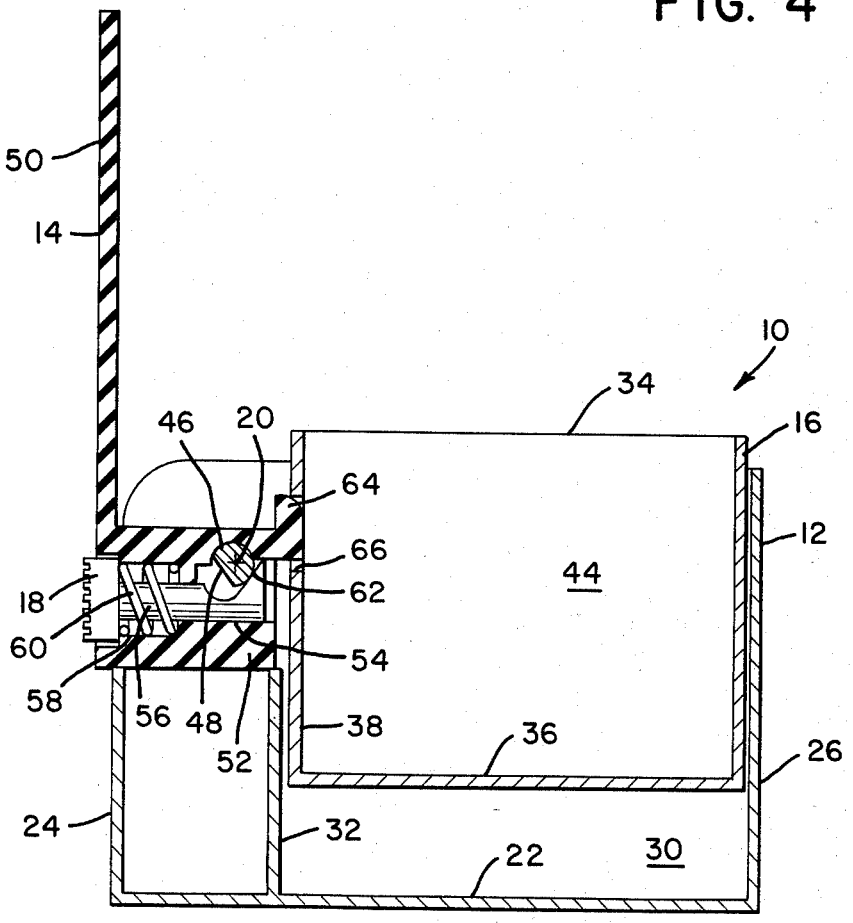
FIG. 5 is a cross-sectional view similar to that of FIG. 4, showing the container lid in an open position.

Referring now to FIGS. 4 and 5, the interior arrangement of the container and the cooperative engagement of the respective parts thereof are shown in each of those figures, with FIG. 4 showing the orientation of the parts when the top wall 14 of the article carrier is in the closed position, and FIG. 5 showing the orientation of the respective parts when the top wall is in the open position. Outer container 12 is of generally rectangular configuration and includes a bottom wall 22, two opposed side walls 24, 26 that extend upwardly from bottom wall 22, and opposed front and back walls 28, 30, respectively, that also extend upwardly from bottom wall 22, back wall 30 being the only one of the front and back walls that is visible in FIGS. 4 and 5. Also extending upwardly from the base is a partition 32 that is positioned between and is parallel to opposed side walls 24, 26. Partition 32 and side wall 26 define a generally rectangular interior volume that is adapted to receive inner container 16.

Inner container 16 is a generally rectangular structure that has an open top 34 and includes a bottom wall 36, side walls 38 and 40, a front wall 42 (see FIG. 3) and a back wall 44. The configuration of inner container 16 is similar to that of outer container 12, but it is of reduced dimensions to permit inner container 16 to be linearly slidably received within outer container 12, between partition 32 and side wall 26.

Outer container 12 carries a fixed rod 46 that defines pivot axis 20, and includes a flat surface 48 that faces away from top wall 14 when the latter is closed. Rod 46 pivotably supports top wall 14, which includes a lid portion 50 and a body portion 52. Lid portion 50 is adapted to overlie and cover the open top of inner container 16. Body portion 52 includes an aperture through which the body portion is pivotably supported on rod 46, and also includes a passageway 54 that extends along an axis that is spaced outwardly from and is perpendicular to pivot axis 20. Passageway 54 slidably receives an actuating button that includes a top push button surface 18 and a body portion 56 that is slidably carried in passageway 54. An enlarged opening 58 coaxial with passageway 54 defined a counterbore adjacent the uppermost surface of body portion 52 to receive a compression spring 60 that acts against the bottom portion of push button surface 18 to urge the push button in an outward direction relative to body portion 52. The innermost end of body portion 56, opposite push button 18, includes an inclined flat surface 62. As shown in FIG. 4, flat surface 62 is in contacting engagement with flat surface 48 on rod 46 when spring 60 urges push button 18 toward its uppermost position, and to wall 14 is in the closed position relative to outer container 12.

As also clearly seen in FIGS. 4 and 5, body portion 52 includes a lip 64 that is on the opposite side of pivot axis 20 from lid portion 50 and extends inwardly toward the interior of outer container 12 and is parallel to lid portion 50. Lip 64 extends into and is received in an opening 66 formed in side wall 38 of inner container 16. Alternatively, instead of having an opening, sidewall 38 can be so configured as to include an ourwardly extending tab, or the like, (not shown) with which the lip is in engagement.

When push button 18 is in its uppermost position, as a result of the urging of spring 60 and as shown in FIG. 4, flat surface 62 on body portion 56 is in direct surface contact with flat surface 48 on rod 46. The spring force of spring 60, acting through body portion 56, urges top wall 14 in a clockwise direction about rod 46 so that top wall 14 overlies the top opening in outer container 12. When push button 18 is depressed, flat surfaces 48 and 62 are disengaged from each other, and the downward force from compressed spring 60 acts on body portion 52 of top wall 14 to pivot it counterclockwise about axis 20 of rod 46, to the position illustrated in FIG. 5, whereupon lid portion 50 is completely displaced from the top opening in outer container 12, thereby exposing the interior thereof. While body portion 52 pivots about rod 46, lip 64 thereon is also carried counterclockwise about axis 20 of rod 46 and engages the upper edge of opening 66 to move inner container 16 in an upward direction away from bottom wall 22 of outer container 12, so that the inner container is carried upwardly toward the open top of outer container 12. Top wall 14 will remain in the FIG. 5 position until it is manually closed.

When outer container 12 is intended to be closed, the lid is manually pivoted in a clockwise direction, as viewed in FIGS. 4 and 5, to return lid portion 50 and inner container 16 to the positions shown in FIG. 4, whereupon the force of spring 60 acting on push button 18 causes flat surface 62 on body 56 to once again contact flat surface 48 on rod 46, to thereby maintain top wall 14 in a closed position. It can therefore be seen that the present container is very simple to open and close, and it can be operated with one hand. In addition to opening the outer container, counterclockwise pivoting of top wall 14 also serves to lift the inner container toward the opening in the outer container, to thereby facilitate the removal of articles therefrom.

Figure 8:
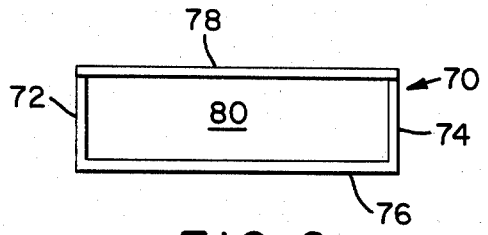
FIG. 8 is a top view of the container holder illustrated in FIG. 6.
Figure 6:
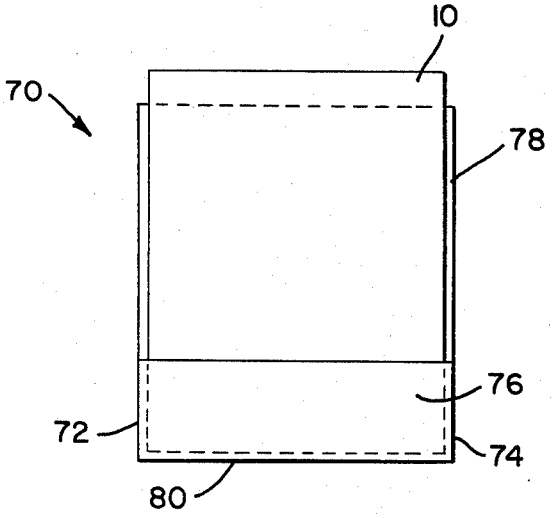
FIG. 6 is a front view of a container holder for receiving and holding a container of the type illustrated in FIGS. 1 through 3.
Figure 7:
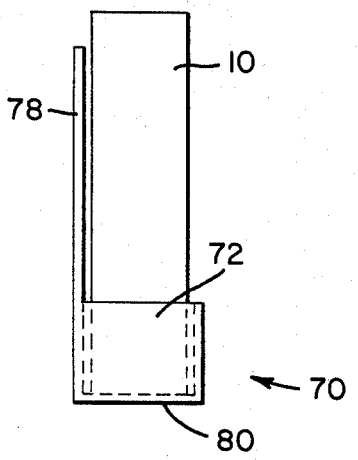
FIG. 7 is a left side view of the container holder shown in FIG. 6.

As disclosed above, the container can be used by itself and carried about by the user. Alternatively, in certain instances it is desirable to place the container in a fixed position. For example, if the container is adapted to contain a package of cigarettes and it is desired that the container be placed in a convenient position in a car, it is desirable that the container be securely held in a predetermined position so that the driver will not have to fumble about and be distracted when attempting to remove a cigarette from the container. Accordingly, as shown in FIGS. 6 through 8, a container holder 70 is provided, and is in the form of a rectangular sleeve that has one closed-end and is so sized and configured as to conform with the cross-sectional size and shape of article carrier 10. Holder 70 includes opposed side walls 72, 74, and opposed front and back walls 76 and 78, respectively, and a closed bottom wall 80 upon which the base of article carrier 10 is adapted to rest. If desired, back wall 78 can be larger than front wall 76, as shown in FIGS. 6 and 7, and the rearwardly facing surface of back wall 78 can carry a suitable adhesive, magnet, double faced tape, or the like, (not shown) to facilitate attachment of holder 70 to an upwardly extending surface in a car, such as a part of the dashboard. Alternatively, if desired, the attachment means can be provided on the outer surface of bottom wall 80 so that the holder can be secured to a substantially horizontally extending surface. Thus, the combination of the sleeve-shaped holder 70 illustrated in FIGS. 6 through 8 and article carrier 10 illustrated in FIGS. 1 through 5, provides an improved carrying arrangement for carrying small articles in a car for easy retrieval by a driver, and without excessively interrupting his ability to properly operate the car.

Although particular embodiments of the present invention have been illustrated and described, it would be apparent to those skilled in the art that various changes and modifications can be made without departing from the spirit of the present invention. Accordingly, it is intended to encompass within the appended claims all such changes and modifications that fall within the scope of the present invention.

We claim:

1. A container for carrying small articles, said container comprising:

(a) an outer container having an open top and a lid pivotable relative to the open top between an open and a closed position to selectively cover and uncover the open top, wherein the outer container includes a pivot shaft extending transversely of and spaced from the open top;

(b) an inner container slidably positioned within the outer container for movement toward and away from the open top of the outer container; and (c) manually operable lid opening means carried by the outer container between a closed and an open position and for simultaneously contacting and sliding the inner container toward and away from the open top of the outer container to elevate articles carried in the inner container to permit easy removal thereof, wherein the lid of the outer container is pivotably carried on the pivot shaft, and wherein the lid includes engagement means in cooperable engagement with the shaft for maintaining the lid in a closed position and for permitting manual disengagement of the engagement means to permit pivoting of the lid relative to the shaft axis between a closed position and an open position.

2. A container in accordance with claim 1, wherein the outer container includes guide means for slidable guiding movement of the inner container toward and away from the open top of the outer container.

3. A container in accordance with claim 2, wherein the guide means includes an interior wall within the outer container and extending toward the open top, and the inner container is in sliding contact with the interior wall and with an exterior side wall of the outer container.

4. A container in accordance with claim 1, wherein the engagement means includes push button means carried by the lid and shaft engaging means carried by the push button means for contacting engagement with the shaft, and spring means to bias the push button means in an outward direction relative to the lid to urge the shaft engaging means into contacting engagement with the shaft.

5. A container in accordance with claim 4, wherein the shaft includes an axially extending flat peripheral surface and the shaft engaging means includes a flat contacting surface for surface engagement with the flat peripheral surface of the shaft to hold the lid in a closed position when the flat surfaces are in contact with each other.

6. A container in accordance with claim 4, wherein the push button means is movable along an axis spaced outwardly from the shaft and outwardly from the inner container.

7. A container in accordance with claim 1, wherein the lid opening means includes projecting means pivotable with the lid and extending laterally of the direction of movement of the inner container and in contact therewith for moving the inner container toward the open top of the outer container when the lid is pivoted from a closed position to an open position.

8. A container in accordance with claim 1, wherein the outer container and the inner container are each of rectangular cross-section.

9. A container in accordance with claim 1, wherein the inner container has an open top that faces the open top of the outer container

* * * * *